US005397109A

United States Patent [19]

Wilson et al.

[11] Patent Number: 5,397,109

[45] Date of Patent: Mar. 14, 1995

[54] REDUCED EMISSIONS METAL MELTING FURNACE

[75] Inventors: Thomas N. Wilson; Milton E. Berry; John D. Butler; Thomas H. Crumbley; Peter W. Ware, all of Carroll County, Ga.

[73] Assignee: Southwire Company, Carrollton, Ga.

[21] Appl. No.: 143,026

[22] Filed: Oct. 29, 1993

[51] Int. Cl.[6] ..... C22B 9/16

[52] U.S. Cl. ..... 266/141; 266/217; 266/900

[58] Field of Search ..... 266/141, 217, 900

[56] References Cited

U.S. PATENT DOCUMENTS 1,889,757 12/1932 Miller ..... 75/653
3,545,918 12/1970 Frundl et al. ..... 266/900
4,309,170 1/1982 Ward .
4,311,519 1/1982 Berry .
4,842,256 6/1989 Bardenheuer ..... 266/900
4,844,426 7/1989 Barnes et al. .

*Primary Examiner*—Melvyn J. Andrews
*Attorney, Agent, or Firm*—Stanley L. Tate; James W. Wallis, Jr.

[57] ABSTRACT

A vertical shaft furnace for melting non-ferrous metals, such as copper, aluminum, and their alloys, includes metal blocks disposed in an annular wall just beneath the charging section of the furnace. Preheated air is forced into the furnace shaft through openings in the wall of metal blocks to burn or oxidize substantially all the CO gas contained in the combustion gases rising from the melting chamber of the furnace. A pressurized plenum surrounding the shaft adjacent the charge opening is used to preheat ambient air which is then supplied under pressure to another plenum above the melting chamber where the preheated air is introduced into the shaft.

20 Claims, 1 Drawing Sheet

REDUCED EMISSIONS METAL MELTING FURNACE

FIELD OF THE INVENTION

The present invention relates to a method of and apparatus for the melting of metals in a furnace, and more particularly to a metal melting furnace and method of operating a furnace in which undesirable combustion emissions, especially carbon monoxide, are reduced.

BACKGROUND OF THE INVENTION

Vertical shaft furnaces and methods for melting metals are well known in the art. Examples of such furnaces and methods are described in U.S. Pat. Nos. 4,311,519 to Berry; U.S. Pat. No. 4,844,426 to Barnes et al.; and U.S. Pat. No. 4,309,170 to Ward, all assigned to the assignee of this invention.

These prior apparatus and methods are directed to melting metals such as copper, aluminum, and aluminum alloys in a shaft furnace. In general, the prior art discloses a shaft furnace, a loading door through which the furnace is charged with the material to be melted, a bottom door, and a sloping hearth at the bottom of the furnace. Generally, the burners are positioned around the lower portion of the furnace so that melting takes place in that portion, with the material to be melted, or the charge, being loaded from above through the loading door. The charge works its way down the furnace and all the material which melts flows out a bottom door or taphole adjacent the hearth.

In one conventional design of a copper melting shaft furnace, a series of copper-blocks are arranged circumferentially about the interior wall of the furnace just below the loading door. Ambient air is admitted to a plenum surrounding these copper blocks to keep the blocks cool so that they do not melt. Copper blocks are advantageously used in this location so that when a scrap metal charge is introduced into the furnace through the charge opening or loading door, the copper blocks absorb the impact of the charge as it is loaded. If a refractory or a metal other than copper is used in this location, it is likely that the molten copper will become contaminated with such refractory or metal. However, because the blocks are made of copper, any particles or chips scraped or chipped off the blocks from the charge impacting thereon will not contaminate the melt.

While the combustion process in the metals melting furnace is complex and not completely understood, analysis of the process is possible on a theoretical basis. However, there are certain fundamental facts of furnace operation which provide a basis on which improved furnace construction and operation is possible. It is known, for example, that there is normally about 1.0% carbon monoxide (CO) in the combustion chamber of the furnace. Typically, there is somewhat less CO just above the top of the charge which has been loaded into the furnace because of partial burning of the CO with the air supplied to the furnace through the charge opening and with the cooling air supplied to the copper blocks, some of which leaks into the stack gases in the furnace. The conclusion that can be drawn is that hot CO in the presence of hot air will burn, or oxidize, without excessively cooling the combustion gases. However, if ambient dilution air is continuously admitted through the charge opening or an open loading door, for example, the air would excessively cool the hot stack gases below the temperature at which the CO will oxidize.

One prior art method for reducing CO emissions is to pass the furnace stack gases through a catalytic incinerator to burn all the remaining CO in the stack gases. Burners installed high in the stack and operating with excess oxygen are also used to burn off CO emissions.

In the case of a copper-melting furnace, molten copper has an affinity for oxygen so that it is typical to operate the furnace with a reducing atmosphere to minimize the pick-up of oxygen by the molten copper and thus minimize the oxygen content of the copper produced by the furnace. Accordingly, the burners are operated fuel rich to provide about 1.0 percent CO in the combustion chamber. This operating condition results in a molten copper from the furnace with an acceptable oxygen content of about 50–100 parts per million. This operating condition also allows substantial CO gas to escape into the atmosphere and, in recent years, this has become an important environmental concern.

In the case of an aluminum melting furnace normally aluminum is melted with an oxidizing flame. However, excess oxygen in the combustion chamber can result in ignition of the molten aluminum and formation of aluminum oxide particles which can be blown about in the furnace interior and potentially block the burner ports. Operation at a slight reducing atmosphere would minimize those problems, but will result in increased CO emissions.

As described above, one method of obtaining reduced CO emissions which has been tried in the past is to use a catalytic incinerator which is expensive to install and maintain. A catalytic incinerator includes a chemical or a metal which allows a combustion reaction to take place at less than normal combustion temperatures, for example, from about 414° F. to about 900° F. Placing extra burners in a furnace stack and operating them continuously with excess oxygen or air also allows burning of all the CO present. However, such an arrangement requires a continuous input of fuel and air to be operational and is uneconomical.

It would be desirable, therefore, to have the capability of operating a metal melting furnace, especially a furnace for melting copper metal, with a reducing atmosphere to avoid unnecessary oxidizing of the molten metal, yet, at the same time, operate the furnace in a condition with substantially no CO emissions.

SUMMARY AND OBJECTS OF THE INVENTION

It is a primary object of the present invention to provide a method of and apparatus for melting metals with reduced undesirable emissions, especially CO emissions.

A further object of the present invention is the provision of a furnace for melting metals which meets or exceeds environmental standards for the control of CO emissions.

Another object of the invention is to provide a metal melting shaft furnace that can be operated fuel rich with a reducing atmosphere in the combustion chamber, yet which emits substantially no or a greatly reduced amount of CO in the stack gases.

Another object of the invention is to provide an air or mechanical damper in the furnace stack to reduce the amount of cold dilution air entering the furnace through the loading door when a charge is loaded into the furnace.

Yet another object of the invention is to provide a furnace apparatus for the melting of non-ferrous metals with reduced CO emissions which is economically constructed and operated.

Still another object of the invention is the provision of a furnace for the melting of non-ferrous metals with reduced emissions which may be operated without requiring extensive controls or monitoring, thus reducing the chances of encountering difficulties in operation.

Briefly described, the aforementioned objects are accomplished according to the method and apparatus aspects of the invention by providing a vertical shaft furnace for melting non-ferrous metals, such as copper, aluminum and alloys thereof, in which preheated air is introduced into the furnace above or into the metal charge in the melting chamber to oxidize or burn the CO in the stack gases and thus substantially reduce the CO emissions from the furnace.

A plenum is provided about the charge opening or loading door section of the furnace for preheating cold or ambient air drawn into the plenum. Heated air from this plenum is introduced into a plenum between the charge opening and the melting chamber at a temperature and flow rate sufficient to oxidize or burn substantially all the CO contained in the gases from the melting chamber.

An air damper or a mechanical damper is also provided in the stack of the shaft furnace above the loading door or charge opening to reduce upward gas flow, which reduces dilution and cooling of the stack gases. If a loading door is provided for the charge opening the damper is used to restrict dilution air when the door is open. If the charge opening is not provided with a loading door, i.e., the charge opening is always open, the damper is used to continuously restrict dilution air.

These and other features, objects and advantages of the invention will become apparent upon consideration of the following detailed description of the invention, the appended claims and to the several views of the invention which are illustrated in the drawings.

DETAILED DESCRIPTION OF THE INVENTION

Figure 1:
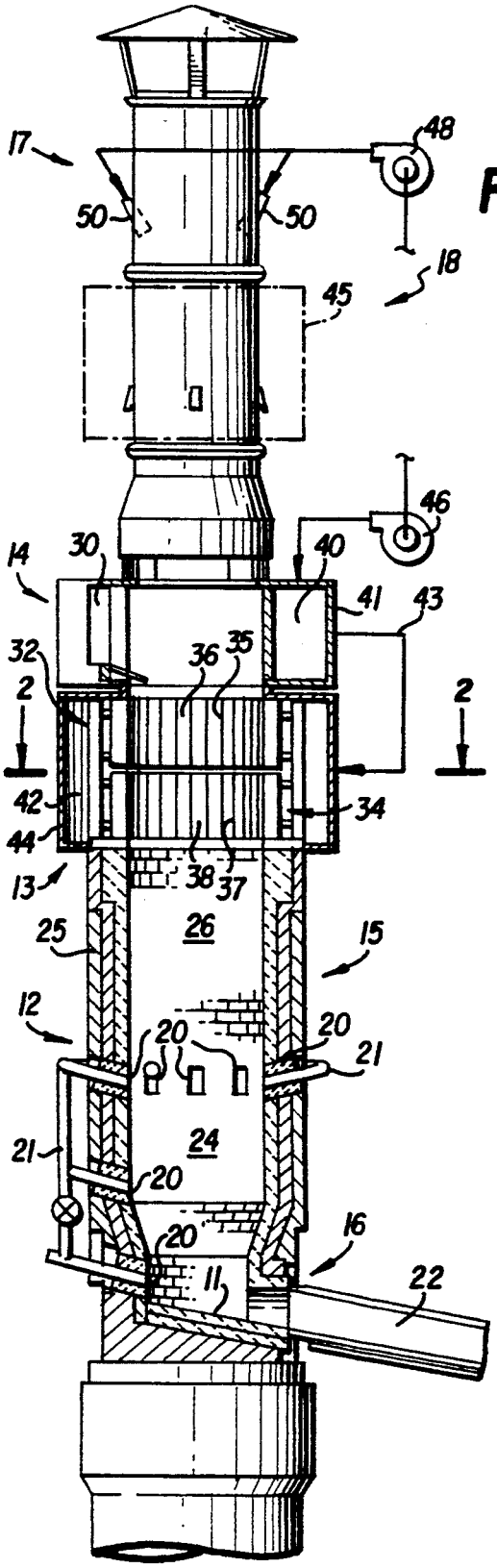
FIG. 1 is a side elevation view, partly schematic and partly in cross-section, of a metals melting furnace made in accordance with the present invention, illustrating the method and apparatus for melting metals with reduced CO emissions.
Figure 2:
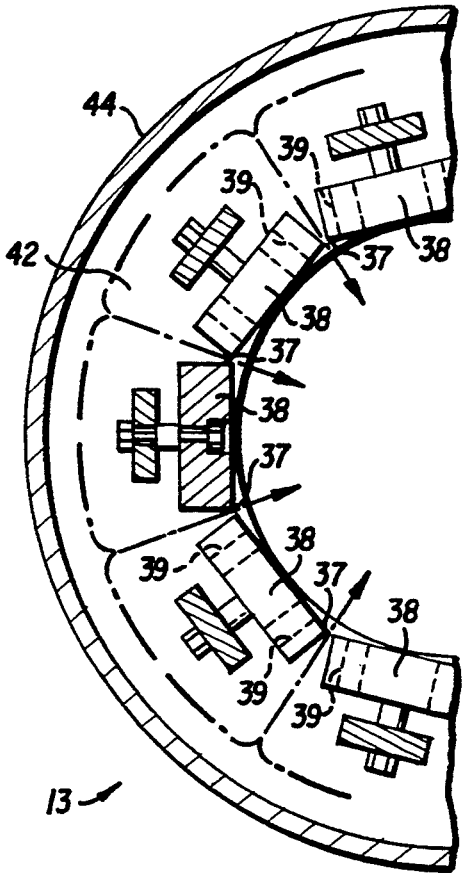
FIG. 2 is a partial cross-sectional view taken along line 2—2 of FIG. 1 showing the preheated air plenum.

Referring now in detail to the drawings, there is illustrated in FIGS. 1 and 2 a vertical shaft furnace for melting non-ferrous metals, such as copper, aluminum and alloys thereof, according to the invention, the furnace being designated generally by reference numeral 10. The furnace is generally elongated, preferably cylindrical in shape, and defines a combustion chamber 12 with a cylindrical furnace wall 15 and a hearth 11. The combustion chamber 12 is adapted to be gravity charged with, for example, copper in a conventional manner either via a continuously open charge opening or a closable loading door 30, disposed in a charge section 14 in the intermediate portion of the furnace above the combustion chamber 12. The height of the furnace is determined based on the desired melting rate. Although the theoretical height of the furnace should be great enough to accomplish transfer of all heat energy to the metal charge, limitations of cost, furnace charging capabilities, and charge-to-furnace wall friction dictate practical furnace height.

Furnace 10 comprises generally, in addition to hearth 11, furnace wall 15, metal charging or charge section 14, an outlet section 16, a stack or flue 18, a damper section 17 and a preheated air section 13. Details of the construction of charging section 14, the preheated air section 13 and the damper section 17 are described hereinafter, particularly with regard to the operation of the preheated air section and the damper section.

The furnace wall 15 comprises a composite refractory lining 26 surrounded by a steel casing 25 which together form a cylindrical melting chamber 24. Advantageously, refractory lining 26 is constructed of an innermost layer of a suitable refractory material, such as, for example, silicon carbide brick backed by heavy-duty firebrick. Any suitable refractory lining may be utilized so long as it is capable of withstanding high temperatures in the melting chamber, chemical attack by the molten metal and the friction generated between the lining and the metal charge.

Burners 20 are positioned in the wall 15 at one or more vertically spaced locations in the melting chamber 24. Burners 20 are supplied with a combustible fuel via piping 21. The burners may be any conventional size or type and may be arrayed in any conventional arrangement consistent with the melting of the non-ferrous metal with which the furnace has been charged, such as those arrangements illustrated in the aforementioned U.S. Pat. Nos. 4,844,426 and 4,309,170. Outlet section 16 is provided with an outlet conduit or taphole 22 at the lowermost point of the hearth 11, as is also known in the art. The fuel generally contemplated for combustion is natural gas, however, any other suitable fuel may be used.

Referring again to preheated air section 13 which is illustrated schematically in FIGS. 1 and 2, a first copper block section 32 is disposed around the inner periphery of the furnace wall at a location just beneath the loading door 30 of charge section 14. A second copper block section 34 is disposed around the inner periphery of the furnace wall directly beneath first copper block section 32. A first row or rows of copper blocks 36 constitute first copper block section 32, and a second row of copper blocks 38 constitute second copper block section 34. While in the preferred illustrated embodiment two sections of copper blocks are used, it will be appreciated that a number of arrangements of copper block sections are possible within the scope of the invention, such as a single copper block section or a single row of copper blocks, consistent with the combustion requirements of the furnace.

The purpose of the copper block sections 32, 34 is to provide a protective surface for the copper charge which is loaded through door 30. The copper blocks are used instead of a brick refractory lining, which would break and crack under the charge, or steel or other metal liner, which would add impurities to the molten copper product if the liner were chipped or flaked during charging. The copper blocks take the form of about 1,000 pound slabs which are lined up side-by-side in an annular arrangement (FIG. 2) to provide the necessary protective surface, i.e., allowing the charged copper to deflect off the copper blocks when the charge is loaded.

In forming copper block sections 32, 34, the copper blocks are installed in such a fashion that air gaps 35, 37 are provided between the individual copper blocks, allowing a communication of air between the interior and the exterior surfaces of the copper block sections. Of course, it would be possible to provide additional channels or holes between or through the blocks if desired, to promote the air flow between the interior and exterior of the row or rows of copper blocks.

Surrounding both of the copper block sections 32, 34 is a plenum 42 which allows the passage of air freely around the outer peripheries of the copper blocks of sections 32, 34 as shown by the arrows in FIG. 2. Plenum 42 is bounded on the circumferential side opposite copper block sections 32, 34 by a steel shell 44 which extends from the steel casing 25 surrounding refractory lining 26 to the charging section 14 beneath loading door 30.

An additional plenum 40 enclosed by a steel shell 41 serves to preheat cool ambient air, which preheated air is supplied to plenum 42 via a pipe 43. An air blower 46, shown schematically in FIG. 1, is conveniently connected to plenum 40, so as to draw ambient air from the surrounding atmosphere and pressurize plenum 40 where it is preheated and then forced into plenum 42 through pipe 43. The heated air which is forced into plenum 42 passes between the gaps 35, 37 or holes through 39 (shown in dashed lines in FIG. 2) in the blocks 32, 34 where it mixes with, oxidizes and burns the CO rising from the melting chamber 24 toward the flue 18.

Thus, in accordance with the present invention, CO emissions reduction is achieved using a plenum around the charge section, or other hot sections of the furnace to preheat ambient air for introduction into the furnace above the charge and below the loading door to oxidize or burn the CO rising from the melting chamber of the furnace. It is also possible, for example, to locate the air preheat plenum above the loading door 30 or charge opening as shown by the plenum 45 in phantom lines in FIG. 1.

The air is preheated in plenum 40 to a temperature such that when the heated air is combined with the hot CO in the furnace a combustion reaction will take place. The preheat temperature is preferably in the range of about 400° F. to about 900° F. Since the copper blocks melt at 1988° F., that air temperature is still sufficient to cool the copper blocks, assuming that the air is introduced at a reasonable flow rate. A preferred range of volumetric flow rate of preheated air into the furnace is dependant upon the melting rate of the furnace and the amount of CO in the gasses. This flow rate of preheated air into the furnace can vary from about 10–900 $ft^3$/min.

Referring again to FIG. 1, there is shown schematically mounted on the stack 18 an air damper 17 which comprises an air blower 48 for drawing in ambient air and supplying it to a plurality of air jets 50 directed at a downwardly inclination. The air jets 50 eject ambient air from the blower 48 downwardly into the flue 18 thereby creating a back pressure in the furnace which reduces upward gas flow. Advantageously, when there is a continuously open charge opening or when the loading door 30 is open to load a charge to the furnace, the air jets 50 create a back pressure which reduces air dilution through the charge opening or loading door 30 and prevents excessive cooling of the furnace gases that might inhibit the combustion of the CO by the preheated air. Although an air damper is preferred, the same effect can be achieved with a mechanical damper (not shown).

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A vertical shaft furnace for melting non-ferrous metals comprising:

a melting chamber in said furnace;

a burner means in said melting chamber for melting the metal charged to the melting chamber;

a charge opening in the shaft of said furnace disposed above said melting chamber for charging metal to be melted to the melting chamber;

means in the shaft of said furnace in proximity to said opening and above said melting chamber for introducing air into the shaft above the melting chamber; and means for preheating the air introduced into the shaft above the melting chamber.

2. The shaft furnace of claim 1, wherein said air preheating means comprises a plenum surrounding said shaft.

3. The shaft furnace of claim 1, wherein said charge opening is closable by a loading door.

4. A vertical shaft furnace for melting non-ferrous metals comprising:

a melting chamber in said furnace;

a burner means in said melting chamber for melting the metal charged to the melting chamber;

a charge opening in the shaft of said furnace disposed above said melting chamber for charging metal to be melted to the melting chamber;

means in the shaft of said furnace in proximity to said opening and above said melting chamber for introducing air into the shaft above the melting chamber, said air introducing means comprising a cylindrical section of said shaft located between the charge opening and the melting chamber, said cylindrical section having disposed therein a plurality of non-ferrous metal blocks forming a generally cylindrical wall, and openings in said wall through which the air is introduced into the shaft.

5. The shaft furnace of claim 4, wherein said air openings are formed by gaps between said blocks.

6. The shaft furnace of claim 4, wherein said air openings are formed by holes through said blocks.

7. The shaft furnace of claim 4, wherein said non-ferrous metal blocks are made of copper.

8. The shaft furnace of claim 4, further comprising a first plenum formed about said cylindrical section and means for supplying preheated air to said first plenum.

9. The shaft furnace of claim 8, wherein said preheated air supplying means comprises a second plenum disposed about the shaft of said furnace adjacent the charge opening and a first blower means connected to said second plenum for drawing air from the ambient atmosphere and pressurizing said second plenum.

10. The shaft furnace of claim 9, including damper means located in said shaft above said charging opening for increasing the pressure in said shaft.

11. The shaft furnace of claim 10, wherein said damper means comprises a second blower means and air jet means communicating between said shaft and said second blower means for introducing ambient air into said shaft in a direction opposite the flow of combustion gases from the melting chamber.

12. The shaft furnace of claim 11, wherein said air jet means are inclined downwardly toward the axis of the shaft furnace.

13. A vertical shaft furnace for melting non-ferrous metals comprising:

a melting chamber in said furnace;

a burner means in said melting chamber for melting the metal charged to the melting chamber;

a charge opening in the shaft of said furnace disposed above said melting chamber for charging metal to be melted to the melting chamber;

means in the shaft of said furnace in proximity to said opening and above said melting chamber for introducing air into the shaft above the melting chamber, said air introducing means comprising a first plenum formed about said shaft; and means for supplying preheated air to said first plenum comprising a second plenum disposed about said shaft adjacent the charge opening and communicating with said first plenum, a first blower means connected to said second plenum for drawing air from the ambient atmosphere and pressurizing said second plenum.

14. The shaft furnace of claim 13, including damper means located in said shaft above said charging opening for increasing the pressure in said shaft.

15. The shaft furnace of claim 14, wherein said damper means comprises a second blower means and air jet means communicating between said shaft and said second blower means for introducing ambient air into said shaft in a direction opposite the flow of combustion gases from the melting chamber.

16. The shaft furnace of claim 15, wherein said air jet means are inclined downwardly toward the axis of the shaft furnace.

17. The shaft furnace of claim 13, wherein said air introducing means further comprises a cylindrical section of said shaft located between the charge opening and the melting chamber, said cylindrical section having disposed therein a plurality of non-ferrous metal blocks forming a generally cylindrical wall, and openings in said wall through which the air is introduced into the shaft.

18. The shaft furnace of claim 17, wherein said air openings are formed by gaps between said blocks.

19. The shaft furnace of claim 17, wherein said air openings are formed by holes through said blocks.

20. The shaft furnace of claim 17, wherein said non-ferrous metal blocks are made of copper.

* * * * *